United States Patent [19]

Sellett et al.

[11] Patent Number: 4,545,439

[45] Date of Patent: Oct. 8, 1985

[54] APPARATUS FOR DETERMINING THE TRUE CROSS SLOPE OF A BLADE

[76] Inventors: Andrew J. Sellett, 570 Sycamore Rd., LaSalle, Ill. 61301; J. Michael Langham, 1920 Plum St., Peru, Ill. 61354

[21] Appl. No.: 510,272

[22] Filed: Jul. 1, 1983

[51] Int. Cl.[4] ..... E03F 3/76

[52] U.S. Cl. ..... 172/430; 33/185 V; 172/4.5

[58] Field of Search ..... 172/2, 4.5, 430; 404/84; 37/DIG. 1, DIG. 20; 33/185 V

[56] References Cited

U.S. PATENT DOCUMENTS

| | | | |
|---|---|---|---|
| 2,961,783 | 1/1960 | Bowen et al. | 172/4.5 |
| 3,026,638 | 3/1962 | Hayner et al. | 172/4.5 |
| 3,052,997 | 9/1962 | Holland | 172/4.5 |
| 3,229,391 | 1/1966 | Breitbarth et al. | 172/4.5 |
| 3,426,146 | 2/1969 | Seaman | 172/4.5 X |
| 3,674,094 | 7/1972 | Kuntz | 172/4.5 |
| 3,678,885 | 7/1972 | Ferguson | 172/4.5 X |
| 3,791,452 | 2/1974 | Long et al. | 172/4.5 |
| 4,053,017 | 10/1977 | Gill et al. | 172/4.5 |
| 4,081,033 | 3/1978 | Bulger et al. | 172/4.5 |
| 4,213,503 | 7/1980 | Elmberg et al. | 172/4.5 |
| 4,431,060 | 2/1984 | Scholl et al. | 172/4.5 |

*Primary Examiner*—Richard T. Stouffer
*Attorney, Agent, or Firm*—Fred Wiviott

[57] ABSTRACT

A blade cross slope sensor includes a first T-member having a stem mounted on the drawbar of a road grader for rotation about a first axis parallel to the axis about which the blade rotates and being coupled to the blade for rotation through the same angle. A yoke is pivotal on the arms of the T-member and a second T-member is pivotal on the yoke about a second axis perpendicular to the first axis. A scissors assembly has a first portion mounted on the grader main frame for pivotal movement about a third axis parallel to the direction that the grader travels and a second portion coupled to the first portion for pivotal movement about a fourth axis parallel to the third axis. The second scissors portion is also pivotally connected to the arms of the second T-member which defines the true cross slope of the blade.

16 Claims, 3 Drawing Figures

APPARATUS FOR DETERMINING THE TRUE CROSS SLOPE OF A BLADE

BACKGROUND OF THE INVENTION

The present invention concerns the sensing of the cross slope of the working tool of a road grader or other surface finishing machine.

In the general case for road surface finishing machines of the road grader type, the slope of the grader blade is not the same as the cross slope, the cross slope being defined as the angle of the road surface with respect to horizontal, measured in a plane perpendicular to the longitudinal direction, i.e., direction of travel. The blade slope and the cross slope are not the same unless the grader blade is positioned in a plane perpendicular to the direction of travel or unless, as in the trivial case, the grader blade, and thus the cross slope, are the horizontal plane. Generally, the actual blade slope is not measured directly because of the adverse physical enviornment at the grader blade. Because there is no place on the grader to mount a slope sensor from which the cross slope can be determined directly, the cross slope must be determined from the blade slope. Mathematically, projecting the blade slope onto a plane perpendicular to the direction of travel yields the true cross slope. It is customary to create a simulated blade slope from which to base the projection.

It is well known in the art to use a control console in the cab of a road grader with means for presetting the slope of the blade and maintaining that slope by servo valves or the like actuated by a pendulum apparatus or its equivalent. The slope sensing device for such systems may be mounted on the blade itself, which reflects true blade slope but not true cross slope.

It is likewise known in the art to have the slope sensing device coupled to a mechanism which computes true cross slope by compensating for the difference between true blade slope and true cross slope. Most of the known methods for performing this computation are extremely expensive, have theoretical built-in errors in their operation, or require exotic, non-standard type mechanical linkages to effect their computation.

SUMMARY OF THE INVENTION

It is a primary object of the invention to provide a new and improved apparatus for determining the cross slope of the blade of an earth moving machine.

Another object of the invention is to provide a true blade cross slope indicator which is simple, reliable, rugged and less expensive than most prior devices.

A further object of the present invention is to provide a device for correctly determining the true cross slope of a road grader blade regardless of blade slope, blade rotation, drawbar shift or drawbar rotation, or any other relative positioning of the grader blade with respect to the main frame of the grader.

Yet another object of the present invention is to provide a cross slope determining device for an earth mover blade wherein all the parts of the mechanism are simple and either rigid or unidirectionally swiveling.

It is yet another object of the present invention to provide a control system for a road grader or the like which assures that the working edge of the grader blade is maintained at the slope required to yield a road surface with the preset cross slope, regardless of the inclination assumed by the grader or the relative angular position of the blade itself.

These and other objects and advantages of the invention will become more apparent from the detailed description thereof taken with the accompanying drawings.

The invention is employed in an apparatus for determining the true cross slope of the blade of a translatable earth moving device having a main frame, a drawbar mounted on the main frame for movement relative thereto, and a blade mounted on the drawbar for rotational movement about a first axis. In general terms, the invention comprises first support means mounted on the drawbar and moveable therewith; first reference means mounted on the first support means for rotation about a second axis parallel to the first axis, second support means mounted on said main frame and oriented in the direction that the earth moving device translates; and means coupled to the blade and to the first reference means for rotating the first reference means through the same angle as the blade is rotated relative to the drawbar. A second reference means is mounted on the first reference means for rotational movement about a third axis perpendicular to the second axis, and a third reference means is mounted on the second reference means for rotation about a forth axis perpendicular to the third axis. The third reference means includes a reference part oriented perpendicular to the fourth axis. A fourth reference means is mounted on the second support means for pivotal movement in a first direction parallel to the direction of movement and in a second direction perpendicular thereto. The fourth reference means also being pivotally coupled to the reference part and defining with the reference part the true cross slope of the blade.

More specifically, the first support means comprises a platform which is fixably mounted in a plane parallel to the drawbar of the road grader. The first reference means comprises a T-member pivotally mounted on the platform, the second reference means comprises a yoke is pivotally mounted on the T-member and the third reference means comprises a second T-member which serves as a simulator of true blade slope.

In order to determine true cross slope, the simulated true blade slope must be projected onto a plane perpendicular to the direction of travel of the grader. This is accomplished in the present invention by the fourth reference means which comprises a scissors mechanism having a rigid parallelogram pivotally connected to a second support mounted on the main frame of the grader and a flexible parallelogram, pivotally connected to the rigid parallelogram and to the main yoke. The scissors mechanism serves to maintain the slope sensor in a plane perpendicular to the direction of travel, while the yoke and the second T-member serve to project the true blade slope onto this plane, thus computing true cross slope. This true cross slope as sensed in the slope sensor may be fed back to a control system to permit automatic maintenance of the blade at the cross slope preset by the operator or to an indicator for manual operator control.

DETAILED DESCRIPTION OF THE PREFERRED EMBODIMENT

Figure 1:
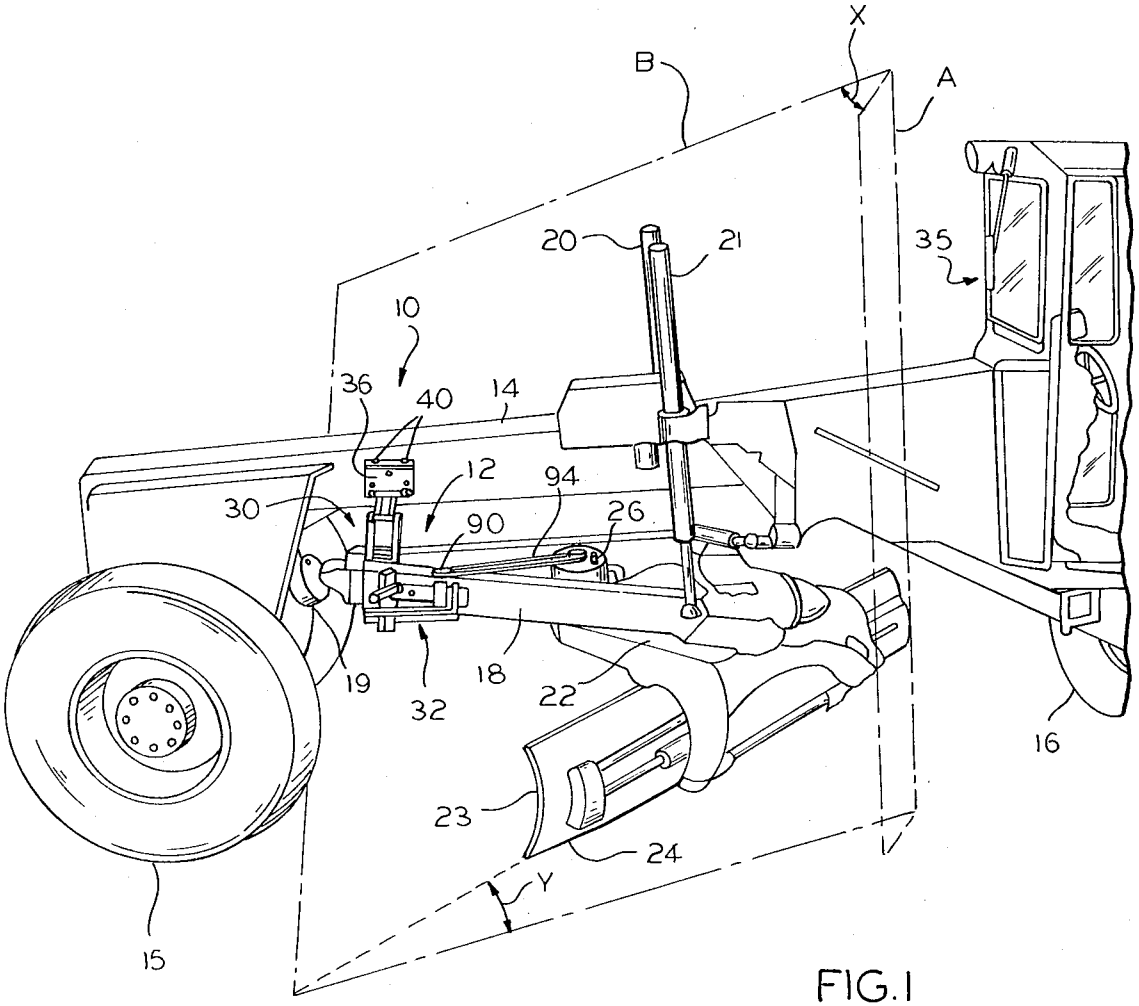
FIG. 1 shows a road grader with which the invention may be employed.

FIG. 1 shows an earth moving machine 10 with which the blade slope sensor 12 in accordance with the preferred embodiment of the invention may be employed. While a particular type of earth moving machine, commonly called the road grader, is illustrated, it will be appreciated that the blade slope indicator has application to other types of earth moving apparatus as well.

Although the details of the road grader 10 form no part of the present invention, it will be described in general terms to facilitate an understanding of how the present invention operates. In particular, the road grader 10 includes a main frame 14 which is generally supported at its opposite ends by front wheels 15 and at its rear by drive wheels 16. Although not illustrated, those skilled in the art will appreciate that a power unit, such as a diesel engine, is also mounted over the rear wheels 16 for moving the grader and to provide power to its various hydraulic and motor driven components. A generally triangular drawbar 18 is supported on and below the main frame 14 by means of a drawbar universal joint 19 located at its forward end and a pair of lift cylinders 20 and 21 extending downwardly from the main frame 14 and which engage the drawbar 18 at its rear corners. A blade circle 22 is mounted below the drawbar 18 for rotation about an axis normal to a plane defined by the lower surface of the drawbar. Fixed below the blade circle 22 is the blade 23 and oriented such that the blade's lower edge 24 is parallel to the plane defining the lower surface of the blade circle 22. The blade circle 22 may be rotated in a plane parallel to a mating lower surface of the drawbar 18 by means of an operator controlled gearbox 26. As a result, the lower edge 24 of the blade 23 will rotate about an axis perpendicular to the plane of the drawbar's lower surface. The drawbar 18 can also be tilted about the universal joint 19 by means of the lift cylinders 20 and 21 which may be operator or automatically controlled.

Among the information required by the operator or automatic control equipment is the true cross slope of the bottom edge 24 of the blade 23. This is the angle made by a projection of the blade edge 24 on to a vertical plane A perpendicular to the travel direction as shown in FIG. 1. However, depending upon the rotation of the blade circle 22, the lower edge 24 of the blade 23 will lie in some vertical plane B forming an angle X of between 0 and 90 degrees relative to plane A. In order to determine the true cross slope of the blade 24, the vertical angle Y of the blade edge 24 in plane B must be projected onto plane A.

Figure 2:
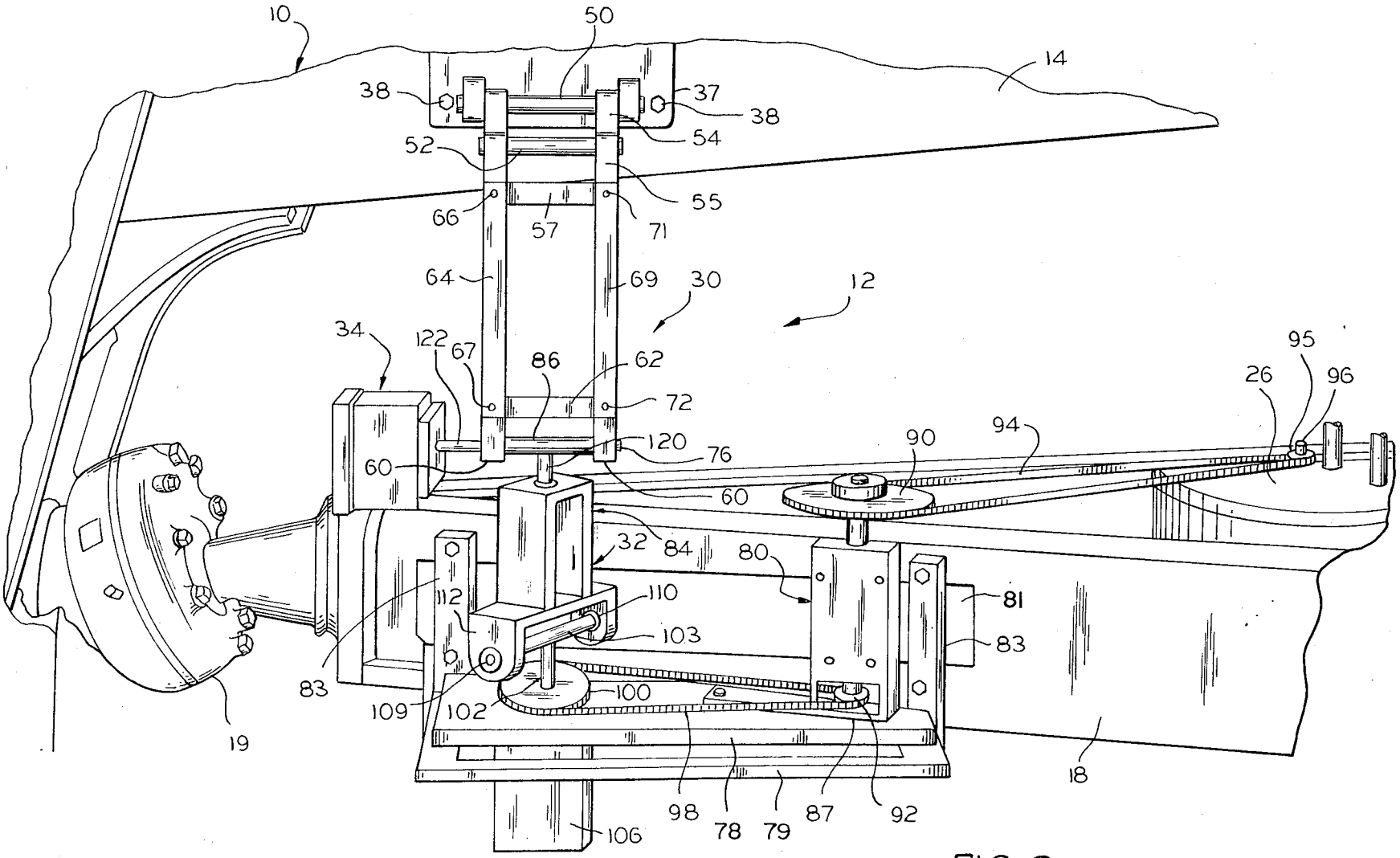
FIG. 2 is a perspective view showing the true cross slope sensor according to the invention in greater detail.
Figure 3:
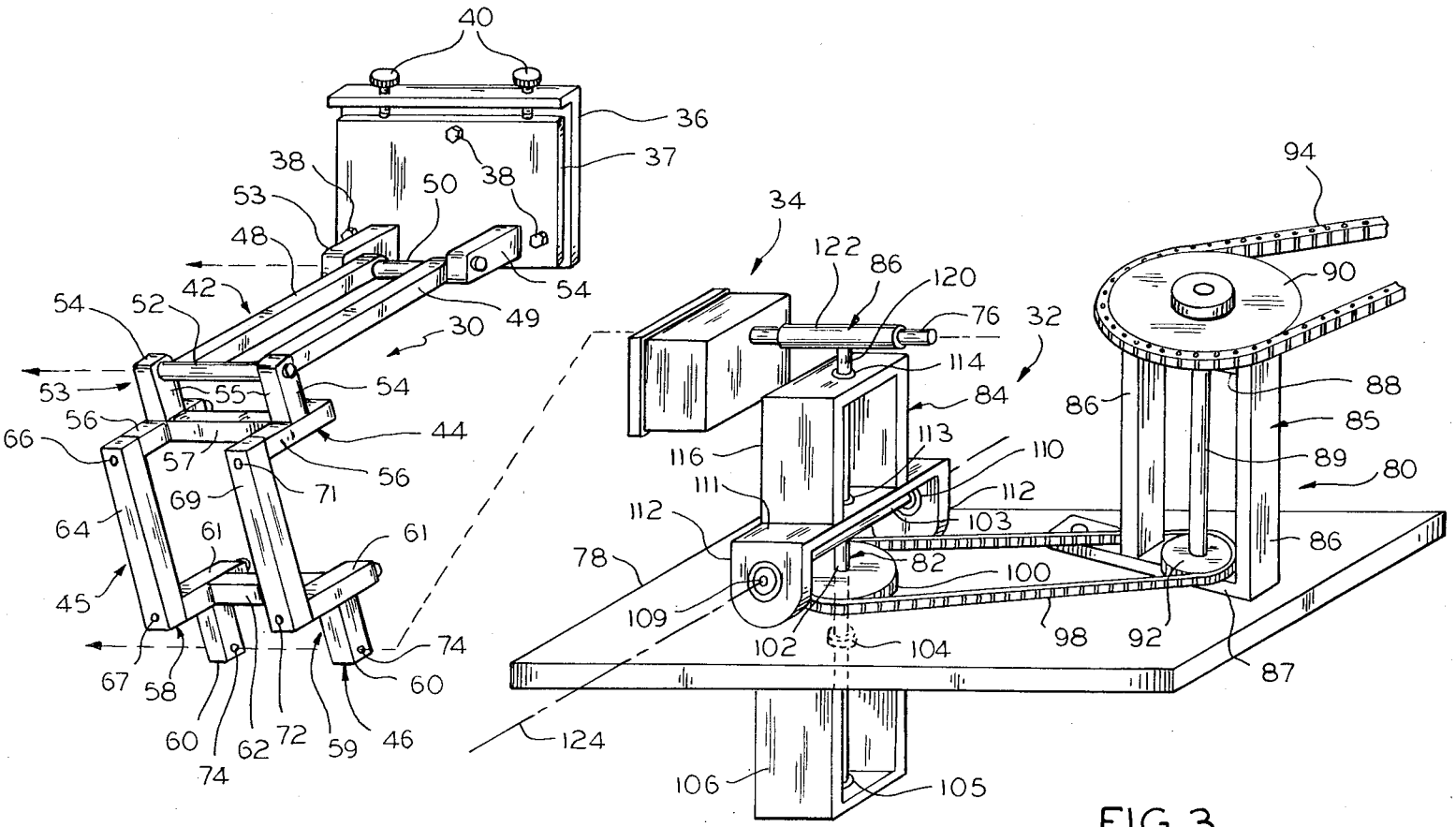
FIG. 3 is an exploded perspective view of the true cross slope sensor shown in FIG. 2.

The apparatus according to the present invention for making this projection is shown in FIGS. 2 and 3. This includes a scissors assembly 30 which establishes the plane A, and a yoke assembly 32 which establishes the angle X between plane B and plane A and the angle Y that the blade edge 23 makes in plane B. The scissors assembly 30 and the yoke assembly 32 are each coupled to a slope sensor mechanism 34 which is operative to provide a signal to an indicator (not shown) in the operator cab 35 or to a control apparatus (not shown).

The scissors assembly 30 includes a main frame plate 36 rigidly mounted on the main frame 14 and oriented parallel to the travel direction. An outer main frame plate 37 is fixed in a parallel relation to the main frame plate 35 by mounting bolts 38 and clamp bolts 40. The mounting bolts 38 pass through openings in the outer frame plate 36 and into threaded holes (not shown) in the main frame plate 35 to permit horizontal leveling of the plate 36.

The scissors assembly 30 also includes a rigid parallelogram 42, an upper yoke assembly 44, a flexible parallelogram 45 and a lower yoke assembly 46. The rigid parallelogram assembly comprises a pair of bars 48 and 49 affixed in a parallel relation to each other by end pins 50 and 52 which are also disposed in a parallel relation to each other. The pin 50 is mounted for rotation on and perpendicularly to a pair of arms 53 and 54 which in turn extend perpendicularly from the outer frame plate 36. Accordingly, the pins 50 and 52 are parallel to the outer frame plate 36 and thereby extend in the travel direction.

The upper yoke 44 includes a pair of inverted T-shaped members 53 and 54, each having an upwardly extending arm 55 and a base 56 perpendicular to the arm 55. The members 53 and 54 are joined in a parallel spaced apart relation by a cross member 57 which is rigidly affixed between the members 53 and 54. Each arm 55 carries a bearing at its upper end for pivotally receiving one of the ends of the pin 52.

The lower yoke 46 also includes a pair of T-shaped members 58 and 59, each of which has a downwardly depending arm 60 and a base 61 perpendicular to arm 60. A cross member 62 having the identical length as cross member 57 joins the members 58 and 59 in a parallel, spaced apart relation.

The flexible parallelogram 45 includes a first bar 64 pivotally connected by pins 66 and 67 which extend coaxially through the base portions 56 and 61 of T-shaped members 53 and 58, respectively. Similarily, a second bar 69 of the flexible parallelogram 45 is pivotally connected by pins 71 and 72 to the T-shaped members 54 at 59. Thus, the lower yoke assembly 46 may translate relative to the upper yoke assembly 30 in a direction parallel to the direction of travel while the upper and lower yoke assemblies 44 and 46 and the flexible parallelogram mechanism 45 may pivot as an assembly about the axis of pin 52. At the lower ends of the arm portion 60 of T-shaped members 58 and 59, there are a pair of bearings 74 which receive the opposite ends of a slope sensor pin 76 which is also coupled to the yoke assembly 32.

The yoke assembly 32 includes a platform which supports a sprocket assembly 79, a lower T-member 81, a yoke assembly 84 and an upper T-member 86 which is coupled to the slope sensor pin 76.

The platform 78 is rigidly affixed to the drawbar 12 by means of a platform holder 80 which includes a rectangular frame 82 to which the platform 78 is affixed and a pair of upwardly extending bars 83 which are suitably bolted to the drawbar 12. The platform 78 is oriented such that its upper surface resides in a plane parallel to that defined by the blade circle 22.

The sprocket assembly 80 includes a sprocket tower 85 affixed to and extending upwardly from the surface of the platform 78. The tower 85 includes vertical supports 86 and a pair of end sections 87 and 88 which are parallel to the upper surface of the platform 78. The end sections 87 and 88 each have a bearing (not shown) for receiving the opposite ends of a sprocket shaft 89 which extends normally to the platform 78. Affixed to the upper end of the sprocket shaft 89 is a first sprocket 90, and a second sprocket 92 is affixed adjacent the lower end of the shaft just above the end section 87. A first sprocket chain 94 extends around the first sprocket 90 and a second sprocket 95 mounted on a shaft 96 extending from the blade circle drive gearbox 26. The shaft 96 is coupled to the gearbox 26 such that it will rotate through an angle which is functionally related to the angle that the gearbox 26 rotates the blade circle 22. A second chain 98 extends around the lower sprocket 92 and a fourth sprocket 100 which is mounted on the lower T-member 82 just above the platform 78.

The lower T-member 82 includes a lower bar 102 and an upper cross bar 103 oriented perpendicularly to the lower bar 102 and parallel to the platform 78. The lower bar 102 extends downwardly through an opening (not shown) in platform 78 and is received in a pair of spaced apart bearings 104 and 105 suitably mounted in coaxial alignment on a support 106 suspended below platform 78. The opposite ends of the upper bar 103 are received in bearings 109 and 110 supported in the main yoke 84.

The main yoke 84 includes a base part 111 having a pair of wings 112 extending perpendicularly downwardly therefrom. The bearings 109 and 110 are mounted in wings 112 so that the upper main yoke may pivot about the axis of the cross bar 103 of T-member 82. In addition, a third bearing 113 is disposed in base part 112 and a coaxial fourth bearing 114 is formed in the upper portion of a generally U-shaped support 116 extending upwardly from the base portion 111. The upper T-member 86 includes a lower bar portion 120 extending downwardly through the bearing 113 and 114 and an upper sleeve portion 122 which is perpendicular to the bar portion 120 and which surrounds the slope sensor pin 76 in a coaxial relation.

In operation, the blade circle gearbox 26 will rotate the sprocket 95 and shaft 96 through an angle functionally related to the angle through which the blade 23 is rotated out of perpendicularity with respect to the direction of travel. The rotation of sprocket 95 is imparted to the first sprocket 90 by the chain 94 which in turn rotates the shaft 89 and the lower sprocket 92 through a second angle functionally related to the angle of blade rotation. Similarily, the rotation of sprocket 92 is imparted to sprocket 100 by chain 98 so that the lower bar 102 of T-member 82 is rotated in bearings 104 and 105 through an angle which is functionally related to the pivot angle of the blade 82. By a proper selection of sizes of the sprockets 90, 92, 95 and 100, the lower T-member can be made to rotate through an angle which is precisely the same as the rotational angle of the blade 23. Also, because the platform 78 lies in a plane parallel to the plane of the blade circle 22, the axis of the upper bar 103 of T-member 82 will be parallel to the lower edge 24 of the blade 23. Thus, the upper bar 103 of T-member 82 comprises a blade slope simulator which remains parallel to the lower edge 24 of blade 23 regardless of drawbar position or blade rotation.

The bearings 109 and 110 allow the main yoke 84 to rotate about the axis of the upper bar or blade slope simulator 103. This has the effect of projecting the blade slope simulator axis onto a first plane B perpendicular to the surface of the road. Physically, this plane is determined by the axes of the bearings 109 and 110 and 113 and 114 of the main yoke 84. In the second projection, the bearings 113 and 114, which allow the T-member 86 to rotate about the main yoke 84, project the results of the first projection onto plane A perpendicular to the direction of travel. The slope sensor pin 76 is mounted coaxially relative to the tubular portion 122 and thus defines the projection of the blade angle onto the plane perpendicular to blade travel. This is sensed by means of the slope sensor mechanism 34 which is affixed to the slope sensor pin 76.

As indicated, the blade slope simulation which is performed by the axis 124 of the upper bar 103 of T-member 82, defines a line parallel to the lower edge 24 of the blade 23. A vertical plane containing this line defines the plane B shown in FIG. 1. In order to determine the true blade cross slope, line 124 must be projected onto the plane A in FIG. 1.

This projection of the line 124 is accomplished by the upper and lower T-members 82 and 76, the main yoke 84 and the scissors assembly 30. In particular, the lower set of bearings 109 and 110 allow the main yoke 84 to rotate about the upper bar 103 of the lower T-member 82 thereby projecting the simulated blade slope into a plane B perpendicular to the road surface. Physically, this plane is defined by a axis of the bearings 109 and 110 and 113 and 114. Because the upper bearings 113 and 114 allow the upper T-bar 86 to rotate relative to the main yoke 84, the blade slope angle is projected onto a second vertical plane containing the axis of the upper tubular portion 122 of T-bar 86. This member is mounted coaxially relative to the slope sensor pin 76 to which the slope sensor mechanism is rigidly mounted. The position of the slope sensor pin 76 is controlled by the scissors assembly 30 which maintains the pin 76 parallel to the outer frame plate 36 although it is free to move in directions parallel to or normal to this plane as a result of the pivotal movement of the rigid parallelogram 42 and the flexible parallelogram 45. Thus, the slope sensor box senses the cross slope by residing in a plane perpendicular to the direction of travel and positioned at an angle with respect to horizontal determined by a projected blade slope. The scissors mechanism 30 insures that this projection occurs in the plane perpendicular to the travel direction.

While only a single embodiment of the invention has been illustrated and described, it is not intended to be limited thereby but only by the scope of the appended claims.

We claim:

1. In combination, a translatable earth moving device having a blade and apparatus for use in determining the true cross slope of the blade, the earth moving device including main frame means and drawbar means mounted on said main frame means for movement relative thereto, said blade being mounted for rotational movement about a first vertical axis on said drawbar means, the improvement comprising:

first support means mounted on said drawbar means and moveable therewith, first reference means mounted on said first support means for rotation about a second axis parallel to said first axis, means coupled to said blade and to said first reference means for rotating said first reference means through the same angle as said blade is rotated relative to said drawbar, a second reference means mounted on said first reference means for pivotal movement about a third axis perpendicular to said second axis, a third reference means mounted on said second reference means for rotation about a fourth axis perpendicular to said third axis, said third reference means including a reference part oriented perpendicular to the fourth axis, second support means mounted on said main frame and oriented in the direction that said earth moving device translates, fourth reference means mounted on said second support means for pivotal movement in a first direction parallel to said direction of movement and in a second direction perpendicular thereto, said fourth reference means being pivotally coupled to said reference part for use in defining with said reference part the true cross slope of the blade.

2. The apparatus set forth in claim 1, wherein said first reference means is generally T-shaped and has a first part extending parallel to said first axis and rotatably mounted on said first support means, said first reference means also including a second part extending perpendicularly to said first part and defining said third axis and which is parallel to a line on said blade, the true cross slope of which is being determined.

3. The apparatus set forth in claim 2, wherein said second reference means is pivotally mounted on the second part of said first reference means, said third reference means including a first part mounted on said second reference means for rotation about said fourth axis, said third reference means including a second part extending along a fifth axis perpendicular to said fourth axis.

4. The apparatus set forth in claim 3, wherein said fourth reference means includes a first part pivotally mounted about a sixth axis parallel to the direction of movement and a second part pivotally mounted about a seventh axis perpendicular to the direction of movement, the second part of said fourth reference means also being coupled to second part of said third reference means for pivotal movement about said fifth axis.

5. The apparatus set forth in claim 4 and including drive means for rotating said blade, and coupling means connecting said drive means to said first reference means for rotating the same through the same angle as said blade.

6. The apparatus set forth in claim 5 wherein said first and third reference means are generally T-shaped.

7. The apparatus set forth in claim 6 wherein said fourth reference means includes a third part mounted on the first part thereof for pivotal movement about an eighth axis parallel to said seventh axis, said first part comprising a pair of members rigidly fixed in a parallel relation, said third part comprising a second pair of members fixed in a parallel relation, said second part comprising a pair of members pivotally mounted respectively on the pair of members defining the third part.

8. The apparatus set forth in claim 7 wherein said first support means comprises a first plate mounted on said drawbar and having a surface lying on a plane perpendicular to said first axis, and said second support means comprises a second plate having a surface lying in a plane parallel to the direction of movement.

9. Apparatus for use in determining the true cross slope of the blade of a translatable earth moving device having a main frame which defines a forward direction and a drawbar mounted on the main frame for movement relative thereto, and wherein the blade is mounted for rotational movement about a generally vertical axis on the drawbar, the apparatus comprising;

first reference means adapted to be mounted on the drawbar of an earth moving device for rotation about a first axis parallel to the axis about which the blade rotates, means adapted to be coupled to the blade of an earth moving device and to said first reference means for rotating said first reference means through the same angle as the blade is rotated relative to the drawbar, a second reference means mounted on said first reference means for pivotal movement about a second axis perpendicular to said first axis, a third reference means mounted on said second reference means for rotation about a third axis perpendicular to said second axis, said third reference means including a reference part oriented perpendicular to the third axis, fourth reference means including a first part adapted to be mounted on the main frame of an earth moving device for pivotal movement about a fourth axis parallel to said forward direction and a second part mounted on the first part for pivotal movement about a fifth axis perpendicular to the fourth axis, said second part being pivotally coupled to said reference part for use in defining with said reference part the true cross slope of the blade.

10. The apparatus set forth in claim 9, wherein said first reference means is generally T-shaped and has a first part extending along said first axis and adapted to be rotatably mounted on the drawbar means of an earth moving device, said first reference means also including a second part extending perpendicularly to said first part of said first reference means and defining said second axis and which is adapted to be parallel to a line on said blade, the true cross slope of which is being determined.

11. The apparatus set forth in claim 10, wherein said second reference means is pivotally mounted on the second part of said first reference means, said third reference means including a first part mounted on said second reference means for rotation about said third axis, said third reference means including a second part extending along said fourth axis perpendicular to said third axis.

12. An apparatus for determining the true cross slope of the blade of a translatable earth moving device having a main frame and a draw bar mounted on the main frame for movement relative thereto, said blade being mounted for rotational movement about a generally vertical axis on the draw bar, said true cross slope determining apparatus comprising:

first support means adapted to be mounted on the draw bar of an earth moving device for movement therewith, first reference means mounted on the first support means for rotation about a first axis which is parallel to the axis about which the blade rotates on the draw bar when the first support means is mounted on the draw bar, coupling means adapted to be coupled to the blade of the earth moving device and to the first reference means for rotating the first reference means about a first axis and through same angle as the blade is rotated relative to the draw bar so that the first reference means defines a line and space parallel to a line on the blade, second support means adapted to be mounted on the main frame of the earth moving device and adapted to be oriented in the direction that the earth moving device translates, second reference means mounted on the second support means for bidirectional movement in a first direction parallel to the direction in which the earth moving device translates and in a second direction perpendicular to the direction of translation, coupling means having a first part pivotally coupled to said first reference means and a second part pivotally coupled to said second reference means, and a slope sensor coupled to said second reference means whereby said slope sensor defines the true cross slope of said blade.

13. The apparatus set forth in claim 12 wherein said coupling means is pivotally connected to said first reference means about a third axis perpendicular to said first axis and to said second reference means about a fourth axis perpendicular to said second axis.

14. The apparatus set forth in claim 13 wherein said first and second reference means are each generally T-shaped, said first reference means having first and second portions defining said first and third axes, respectively, and said second reference means having first and second portions defining said second and fourth axes, respectively, said coupling means being pivotally mounted on the second portions of each said first and second reference means.

15. The apparatus set forth in claim 14 and including linkage means disposed between said second reference means and said second support means, said linkage means having a first portion which pivots in the direction of translation and a second portion which pivots in said perpendicular direction.

16. The apparatus set forth in claim 12 and including linkage means disposed between said second reference reference means and said second support, said linkage means having a first portion which pivots in the direction of translation and a second portion which pivots in said perpendicular direction.

* * * * *